US005936212A

United States Patent [19]

Whitehall et al.

[11] Patent Number: 5,936,212

[45] Date of Patent: Aug. 10, 1999

[54] ADJUSTMENT OF ELEVATOR RESPONSE TIME FOR HORIZON EFFECT, INCLUDING THE USE OF A SIMPLE NEURAL NETWORK

[75] Inventors: Bradley L. Whitehall, Menomonee Falls, Wis.; Bruce A. Powell, Canton, Conn.

[73] Assignee: Otis Elevator Company, Farmington, Conn.

[21] Appl. No.: 08/999,159

[22] Filed: Dec. 30, 1997

[51] Int. Cl.[6] ..... B66B 1/18; B66B 1/34

[52] U.S. Cl. ..... 187/382; 187/391; 187/387

[58] Field of Search ..... 387/380, 382, 387/387, 391, 393

[56] References Cited

U.S. PATENT DOCUMENTS

| | | | |
|---|---|---|---|
| 5,146,053 | 9/1992 | Powell et al. | 187/127 |
| 5,229,559 | 7/1993 | Siikon et al. | 187/384 |
| 5,305,198 | 4/1994 | Schroder et al. | 705/8 |
| 5,338,904 | 8/1994 | Powell et al. | 187/137 |
| 5,388,668 | 2/1995 | Powell et al. | 187/387 |
| 5,412,163 | 5/1995 | Tsuji | 187/382 |
| 5,427,206 | 6/1995 | Powell et al. | 187/387 |
| 5,616,896 | 4/1997 | Kontturi et al. | 187/384 |
| 5,672,853 | 9/1997 | Whitehall et al. | 187/380 |

*Primary Examiner*—Robert E. Nappi

[57] ABSTRACT

For elevator car dispatching scenarios, the standard remaining response time (RRT) estimation is augmented by a selected amount of time where a horizon floor is to be served before reaching the hall call to be assigned. The augmentation may be made by adding a fixed RRT penalty, by assuming a car call stop after the horizon floor at a selected floor, or by using a neural network.

12 Claims, 7 Drawing Sheets

CALCULATION PROCEDURE FOR HORIZON EFFECT ADJUSTMENT TO RRT

NOTE: For the dispatching situations illustrated in Figures 1 and 3 where the Lobby is assumed horizon floor, the detailed questions in the decision block in the above flow chart would be: (1) Is the direction of the hall call DOWN? and (2) Is the direction of the candidate car DOWN? and (3) Is the position of the candidate car below the hall call? The answers must be "YES" to all questions before the RRT adjustment applies.

A SHORT TIME LATER

STRAIGHTFORWARD RRT CALCULATION

CONSTANT "KICKER" ADDED TO RRT

ASSUMED TRAVEL TO TOP OF RISE

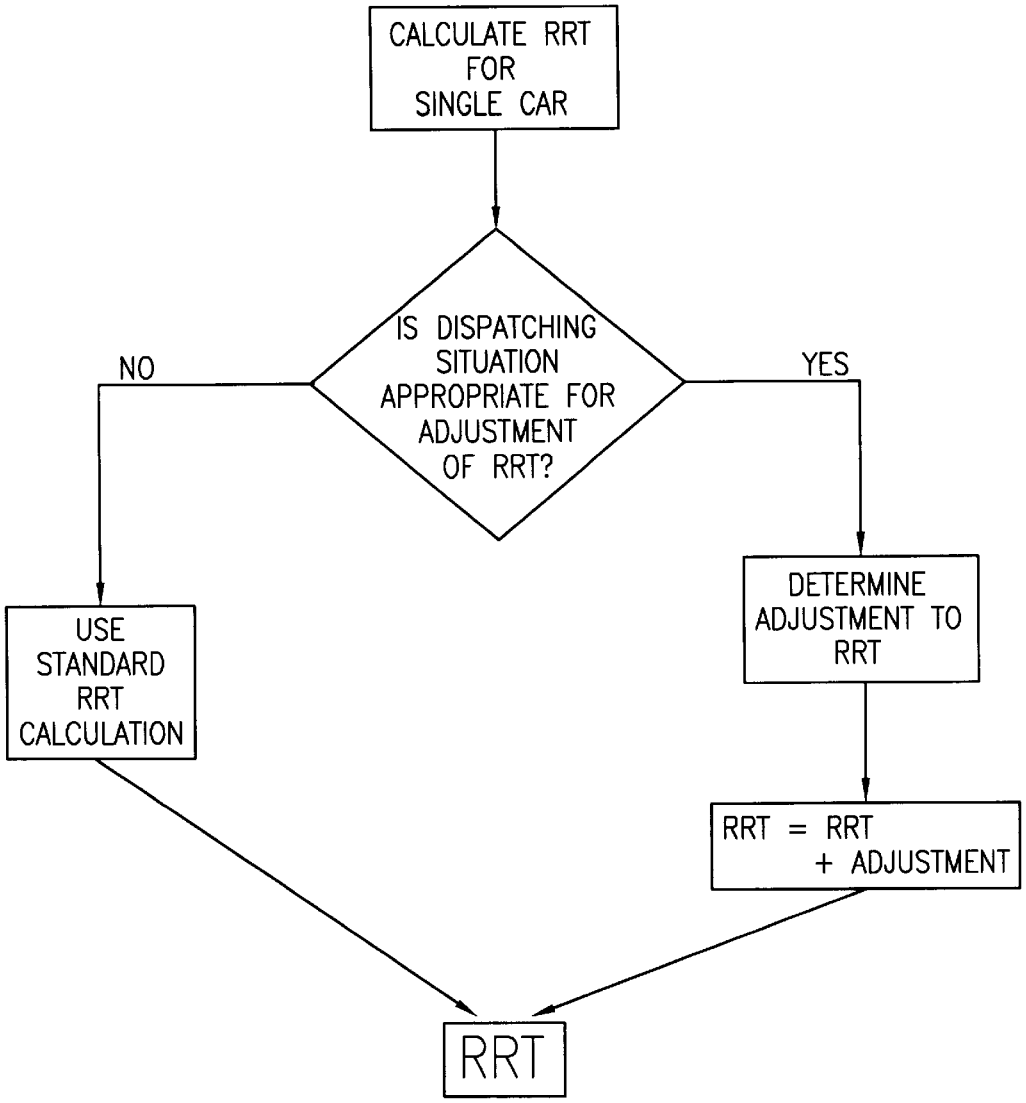

FIG. 9

CALCULATION PROCEDURE FOR HORIZON EFFECT ADJUSTMENT TO RRT

NOTE: For the dispatching situations illustrated in Figures 1 and 3 where the Lobby is assumed horizon floor, the detailed questions in the decision block in the above flow chart would be: (1) Is the direction of the hall call DOWN? and (2) Is the direction of the candidate car DOWN? and (3) Is the position of the candidate car below the hall call? The answers must be "YES" to all questions before the RRT adjustment applies.

ADJUSTMENT OF ELEVATOR RESPONSE TIME FOR HORIZON EFFECT, INCLUDING THE USE OF A SIMPLE NEURAL NETWORK

BACKGROUND OF THE INVENTION

1. Technical field of the Invention

The invention relates to elevator dispatching and, more particularly, to improvements in estimating remaining response time (RRT) to answer a hall call.

2. Discussion of Related Art

Remaining response time (RRT) is the amount of time that a given elevator will require to reach a given hall call floor. For example, a car in the down direction and parked at floor 9 might require 6.0 seconds to respond to a newly registered down hall call on floor 7; in that case it is said that the RRT equals 6.0 seconds. The RRT for another car presently on floor 16 would be much longer. Another important illustration of RRT is the case where a car is in the process of responding to a hall call that has already been waiting for some time. Here, the RRT is the time from now until the car arrives at the hall call floor. The RRT is a key concept in dispatching decisions.

Co-owned US patents pertaining to RRT include, among others, U.S. Pat. Nos. 5,146,053; 5,388,668; 5,427,206; and 5,672,853. Clearly, accuracy of an estimation procedure for RRT is critical, especially as it is applied to dispatchers with ECA (Early Car Announcement: See U.S. Pat. No. 5,338,904).

An especially bad scenario occurs when a car has been assigned to a hall call based on an estimate that the RRT would be short (say 20 seconds), only to discover a few seconds later that the actual response time will be excessively long (say 90 seconds). With a system of car announcement commonly used in North America, the hall call would be reassigned to another car. With instantaneous car assignment(ICA) systems commonly used elsewhere, however, no such reassignment is permitted. A class of problems that is susceptible to such gross errors of RRT estimation leading to poor assignments is illustrated in FIG. 1, where a down traveling car is a candidate for assignment to a down hall call above the car (symbolized by inverted delta). The straightforward calculation of RRT would be something like 21 seconds as follows: travel from 2 to L (five seconds) plus stop at L (10 seconds) plus travel from L to 3 (six seconds). However, between the assignment of the car to the hall call and the car's answering the call (i.e., reaching the hall call floor) the car will often become burdened with commitments that will delay the car's response to the hall call. For this example, the lobby floor forms a "horizon" beyond which the car cannot "see." What is waiting over the horizon is the potential generation of car calls due to the extra level of passenger traffic at the lobby. During the time that the car is stopped at the lobby, people will board the car and enter car calls (symbolized by bullets) that will require the car to travel up into the building, far beyond floor 3, as shown in FIG. 2. For this situation, there is a need to add some number of seconds to the straightforward RRT value to account for the extra time that will often be required.

SUMMARY OF INVENTION

An object of the present invention is to provide a way to adjust the estimate of RRT over and above the straightforward calculation procedure described above.

In other words, this object is to help "see" beyond a "horizon" at the lobby floor or any other horizon floor and thereby overcome the problem of unforseen car calls that potentially cause a predicted remaining response time to become very long. The present invention applies for example to dispatching situations in which a candidate car has the possibility of being required to visit a horizon floor such as the lobby, e.g., prior to responding to a down hall call registered above the downwardly traveling car.

According to the present invention, an improved method for estimating remaining response time (RRT) for a candidate elevator car to serve a registered hall call comprises the steps of determining a standard RRT based on the location of the candidate elevator car, direction of travel, distance of travel to the registered hall call, and number of stops for registered car calls before reaching the registered hall call, and determining if the candidate elevator car must stop at a floor with expected high traffic before reaching the registered hall call and if so, determining an adjustment to the standard RRT for providing an adjusted RRT and otherwise providing said standard RRT.

In further accord with the present invention, such an adjustment can be carried out in at least three different ways.

These three ways to carry out the present invention, for use in adjustment of the estimate of RRT, are exemplified below in detail. Based on the teachings hereof, anyone of skill in the art can carry out the invention using these or similar techniques. The first way is simply the addition to RRT of a fixed penalty to account for the extra car calls that the car often encounters. This penalty might be on the order of 20 seconds. The second involves factoring into the RRT estimate one extra car call stop, usually at the top of the rise. The third is a simple neural network that can be trained to predict the number of car calls that the candidate car will encounter. This number of new car calls that are "over the horizon" will clearly be a function of (a) the time since the last car left the lobby, (b) the time needed by the present car to reach the lobby, and (c) the traffic intensity at the lobby.

Other objects, features and advantages of the present invention will become apparent in light of the description of a best mode embodiment thereof which follows.

BRIEF DESCRIPTION OF THE DRAWING

FIG. 7*a* illustrates a simple neural network that can be used to predict the number of car calls that a car will experience.

FIG. 9 illustrates a calculation procedure for the horizon effect adjustment to the RRT.

DETAILED DESCRIPTION OF PREFERRED EMBODIMENTS

As discussed above in connection with FIGS. 1 and 2, an especially bad scenario for estimating remaining response time (RRT) occurs when a car has been assigned to a hall call based on an estimate that the RRT will be short (say 20 seconds), only to discover a few seconds later that the actual response time will be excessively long (say 90 seconds). With known systems of car announcement used in North America and elsewhere, the hall call would be reassigned to another car. In locales where instantaneous call assignment (ICA) and announcement are utilized, no such reassignment is permitted.

Figure 1:
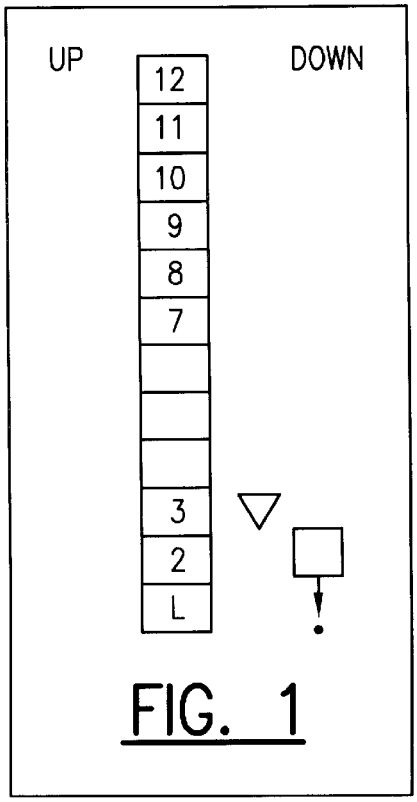
FIG. 1 illustrates an elevator car dispatching scenario in which the estimation of remaining response time (RRT) is susceptible to gross error leading to poor elevator car assignment to registered hall calls.
Figure 3:
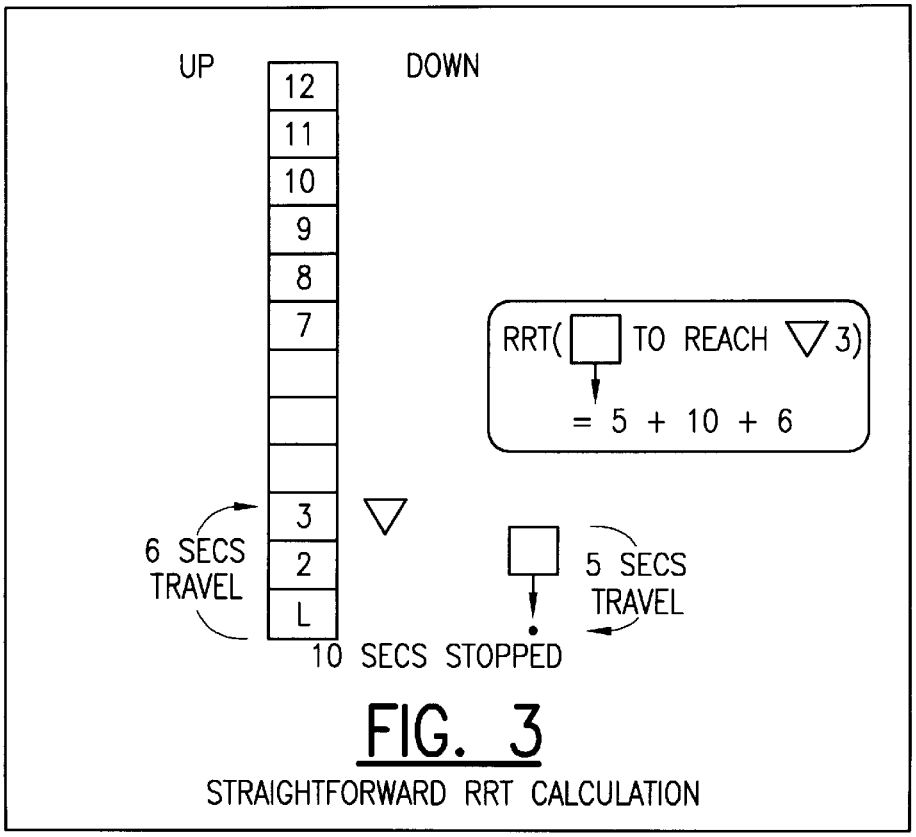
FIG. 3 is another illustration of a straightforward RRT calculation for a down traveling car which is a candidate for assignment to a down hall call above the car.

A class of problems that is susceptible to such gross errors of RRT estimation leading to poor assignments was illustrated in FIG. 1 above where a down traveling car is a candidate for assignment to a down hall call above the car. A straightforward calculation of RRT for such a case is illustrated in FIG. 3. This RRT of some 21 seconds comprises three time segments: travel from 2 to L (5 seconds) plus stop at L (10 seconds) plus travel from L to 3 (six seconds). However, during the time that the car is stopped at the lobby, people will board the car and enter car calls that will require the car to travel up into the building, far beyond floor 3. For this situation therefore, there is a need to add some number of seconds to the straightforward RRT value to account for the extra time that will often be required.

Figure 2:
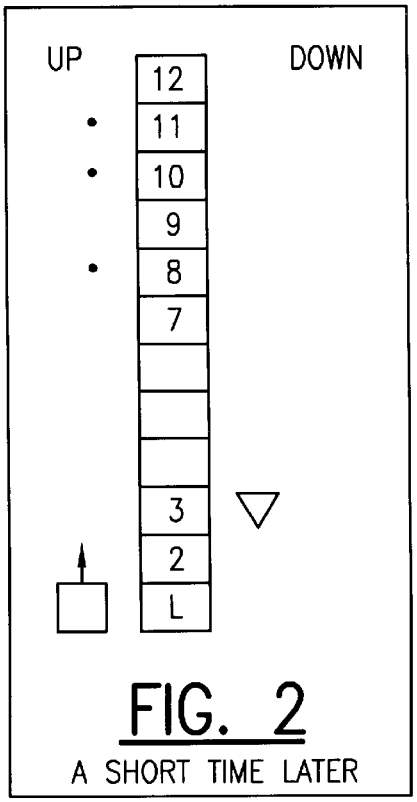
FIG. 2 illustrates a continuation of the scenario of FIG. 1 in which it becomes evident that the "horizon" of the lobby floor beyond which the dispatching algorithm applied to the scenario of FIG. 1 could not "see," has caused a poor assignment of an elevator car to answer a hall call.
Figure 4:
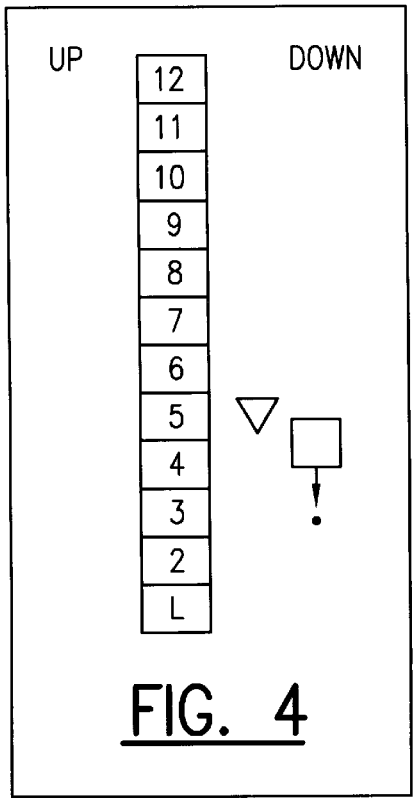
FIG. 4 shows an even more difficult situation in which the downward traveling car is not yet committed to go to the lobby where and up hall call at the lobby is then registered.

In addition to the situations of FIGS. 1–3, an even trickier situation is illustrated in FIG. 4. Here, the car is not yet committed to go to the lobby. However, in the time that it takes for the car to reach floor 3 and turn around, and up hall call at the lobby might be registered and be assigned to this car.

Three methods for adjusting the RRT to account for the car calls that a car might encounter beyond a "horizon" floor are shown and described in detail below.

Fixed RRT Penalty

Figure 5:
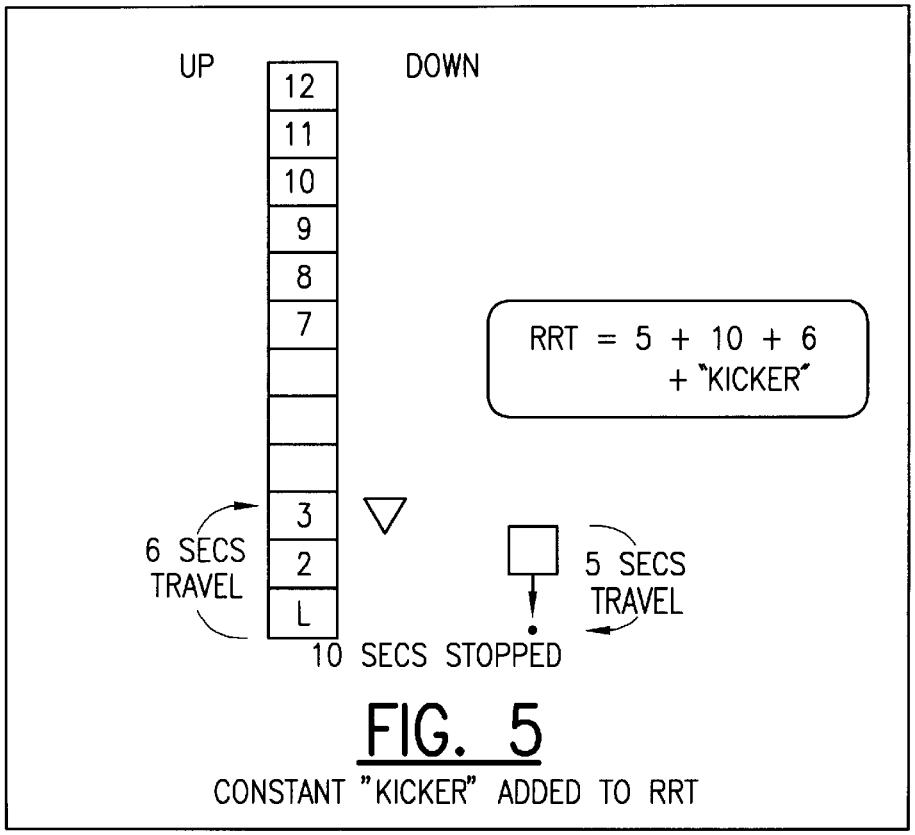
FIG. 5 illustrates the first three embodiments of the present invention for adjusting the RRT by adding a fixed RRT penalty to account for car calls that a car might encounter over the horizon floor.

The first approach is to add a fixed penalty of, e.g., 20 seconds to the RRT of a car in the situations described. This is illustrated in FIG. 5. The advantage of this method is that it is simple and easy to implement. However, it is clear that the so-called "kicker" of 20 seconds ignores state information and traffic activity. Also, depending on the value of the kicker, the RRT estimate will be too high when a few (or even zero) passengers enter the car at the horizon floor and too low when more than a few or a great many passengers enter the car.

Assumed Car Call Stop

Figure 6:
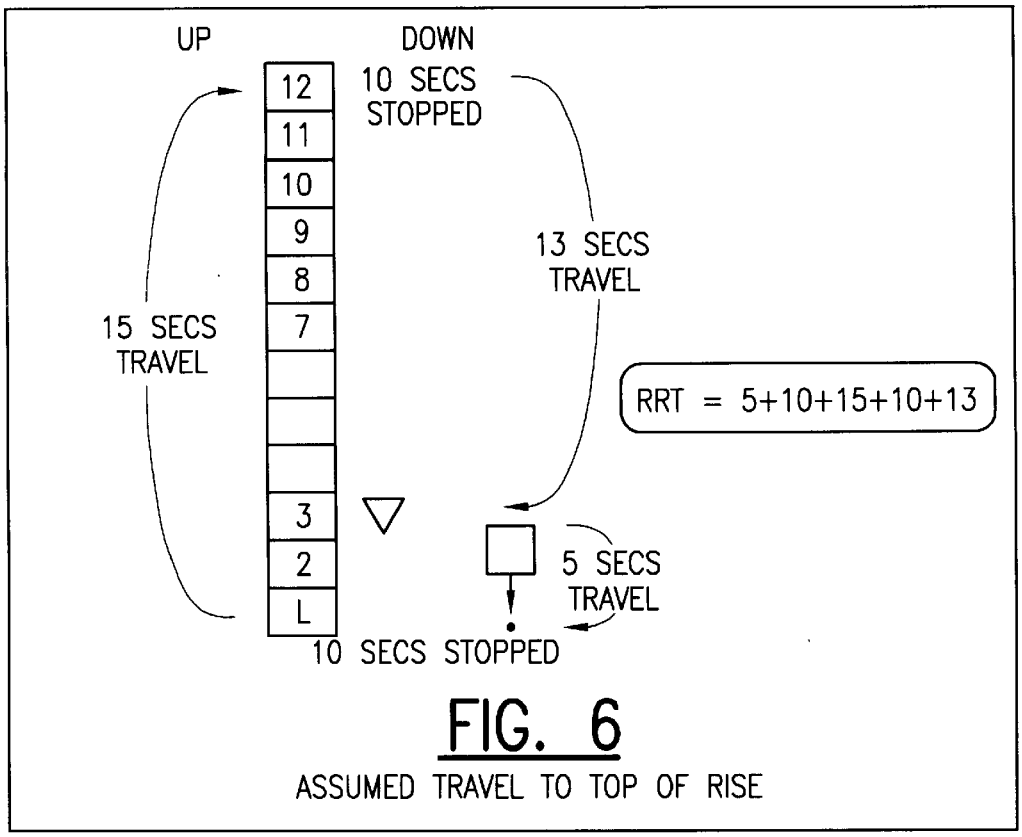
FIG. 6 illustrates the second of the three embodiments of the present invention for adjusting the RRT by assuming a car call stop to account for car calls that a car might encounter over the horizon floor.

A second approach is to assume that a car visiting the lobby would have to travel to the highest floor served by the group before responding to any down hall call. This is illustrated in FIG. 6. (A variant of this second approach is to assume that the car would have to travel to a floor in the middle of the rise or at some other floor before responding to down hall calls.) Again, this method is easy to implement, e.g., by adding 15 seconds in the up direction, 10 seconds to stop, and travel time to the hall call in question, in this case 13 seconds. However, the procedure again ignores the fact that sometimes the car will encounter more than one car call when it reaches the horizon floor.

Simple Neural Network

The third approach is to use a neural network for adjusting the RRT for dispatching situations such as shown in FIGS. 1 and 4. A neural network for elevator dispatching is shown in U.S. Pat. No. 5,672,853. More specifically, however, a neural network according to the invention provides an intelligent and trainable procedure to account for events that (a) cannot be "seen" over the horizon and (b) have the the potential to produce terrible car to hall call assignments if not properly predicted. The basic idea is as follows: the longer the time interval between visits of cars to the horizon floor (usually the lobby), the more likely it is that there will be several potential car calls waiting for the candidate car. In that case the RRT value for a car in the situations of FIGS. 1 and 4 would be the sum of three terms:

(1) time to reach the lobby, (2) time to service predicted car calls from the lobby, if any, and (3) time to travel from the highest car call to the hall call floor.

Figure 7B:
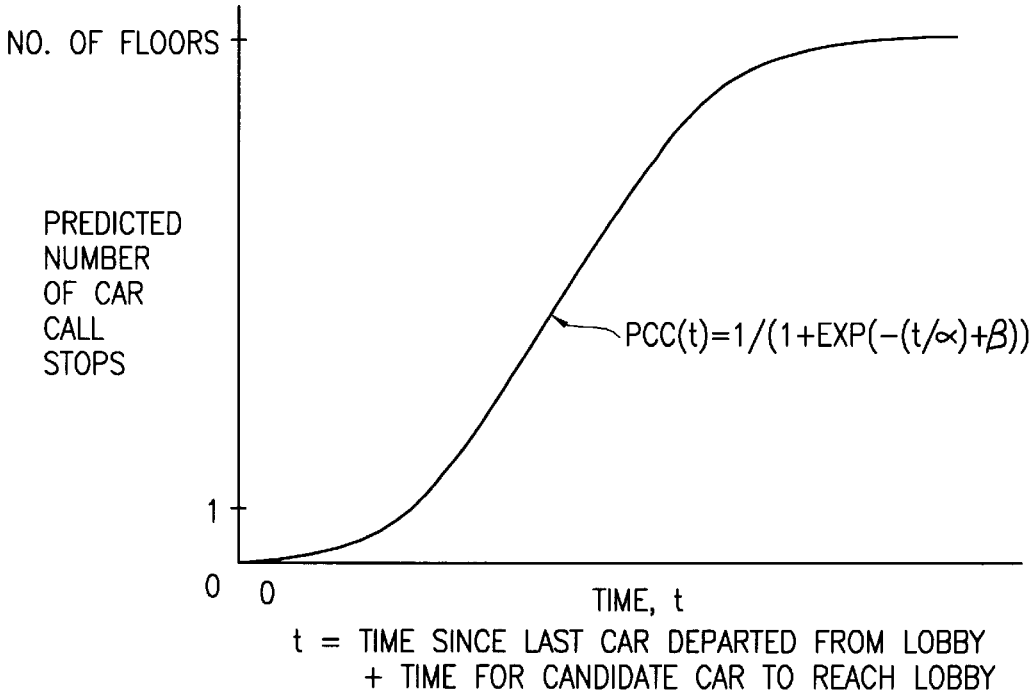
FIG. 7*b* illustrates the shape of a sigmoid function used in the neural network
Figure 7A:
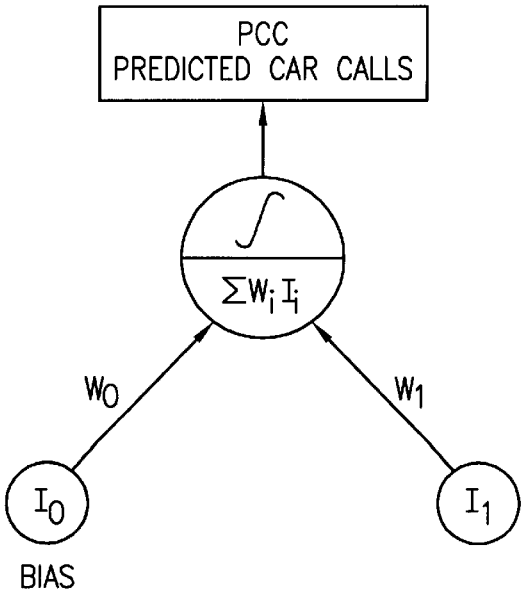
FIGS. 7*a,* 7*b,* and 7*c* illustrate the third of the three embodiments of the present invention for adjusting the RRT by means of a simple neural network to account for car calls that a car might encounter over the horizon floor.

The trick to the formula is predicting terms (2) and (3), the time required to travel up from the lobby to the new hall. Obviously, the number of (unknown) car calls is the major contributor to this time. The invention estimates the number of car calls with a learned PCC (Predicted Car Call) function. This function uses the length of time since the lobby (or horizon floor) was last visited in order to project the number of car calls the car will encounter when it reaches the horizon floor. FIG. 7*a* illustrates a simple neural network that can be used to predict the number of car calls that a car will experience. It should be realized that various neural networks may be used with inputs and outputs differing in number and kind from that shown. In the simple example of FIG. 7*a,* there are two input nodes, I0 and I1. Node I0 is a bias node and can be present for any neural network. Input node I1 is the sum of the time since the last car departed from the lobby (or horizon floor) and the time for the candidate car to reach the lobby (or horizon floor) from its current position. w0 and w1 indicate the network weights. These weights must be learned with training examples. The weighted sum of the inputs is subjected to a well-known sigmoid function. The output of the neural network is then the predicted number of car calls. FIG. 7*b* illustrates the shape of such a sigmoid function used in the neural network. The slope of the curve is dependent on the value for alpha, and the offset is dependent on the value for beta. This function is monotonically increasing with a minimum value of zero and a maximum value equal to the number of floors served by a group of cars.

Figure 7C:
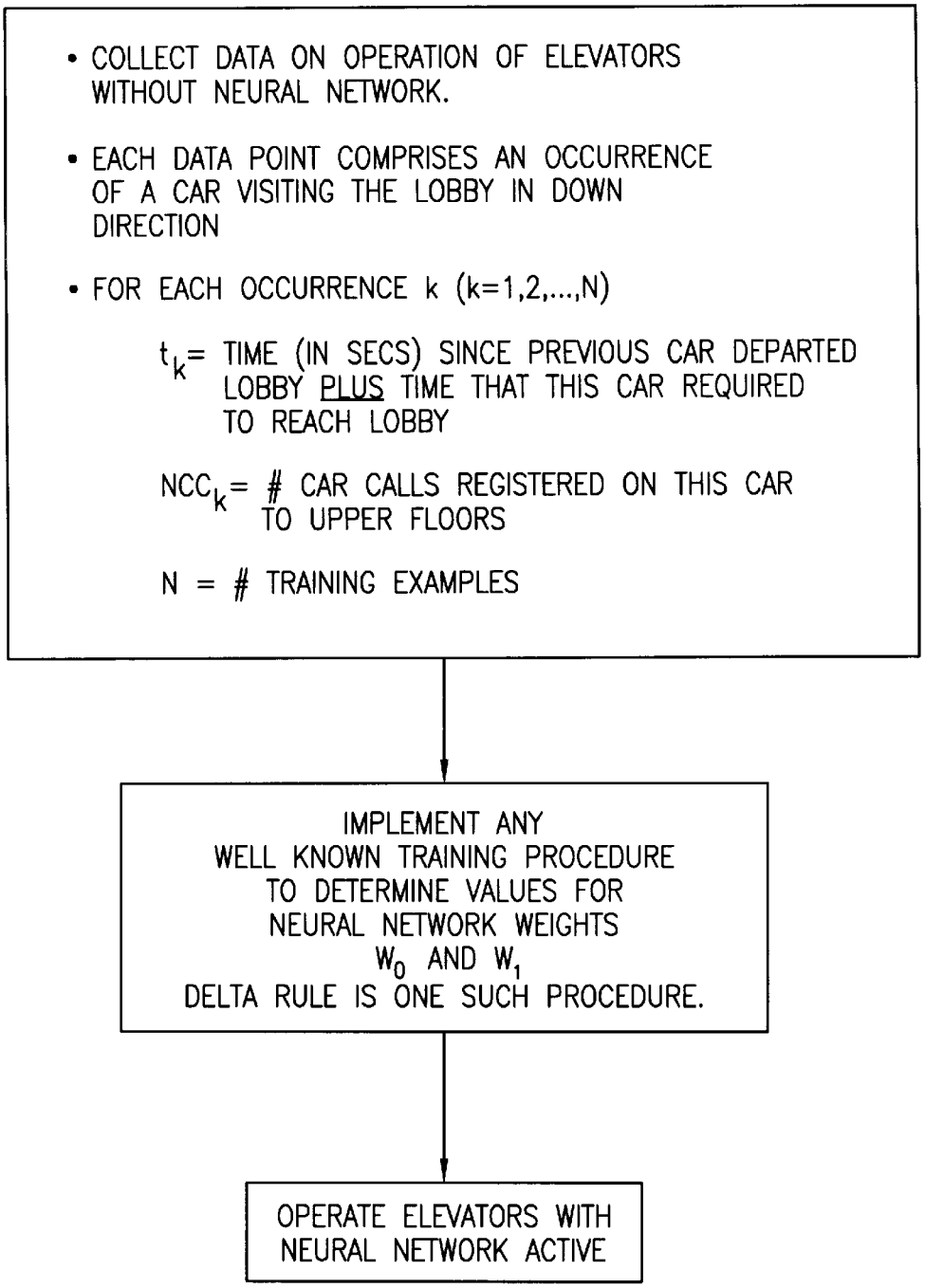
FIG. 7*c* illustrates a procedure for training the neural network to learn the weights based on training examples.

Training the network to learn the correct values for any building is simply a matter of using the delta rule (well known in the neural network literature) to adjust w0 and w1 to provide accurate results. After a car has landed at the lobby, a comparison is made between the predicted number of car calls and the actual number received. The network weights are adjusted appropriately. FIG. 7*c* shows a procedure for training the neural network. In a first step, data is collected on the operation of the elevator cars without the neural network. Each data point comprises an occurrence of a car visiting the lobby in a down direction, e.g., as shown in FIG. 7*c*. In a second step, any known training procedure is implemented to determine values for neural network weights w0 and w1. The Delta Rule is one such known procedure. Finally, the elevator cars are operated with the neural network active.

Dispatching Algorithm & System

Figure 8A:
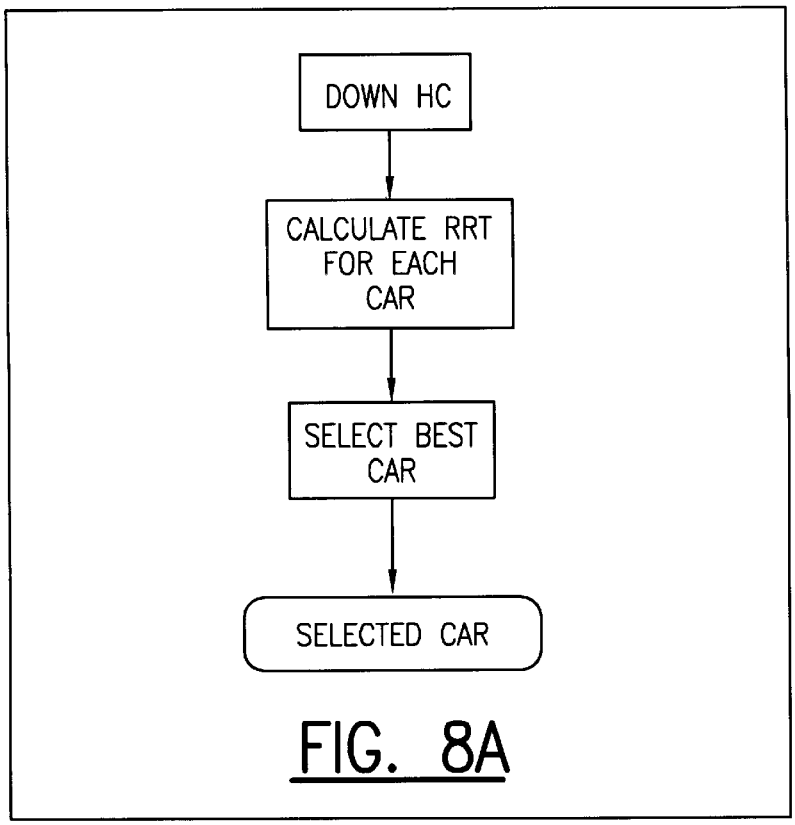
FIG. 8A shows an algorithm for carrying out the present invention.
Figure 8B:
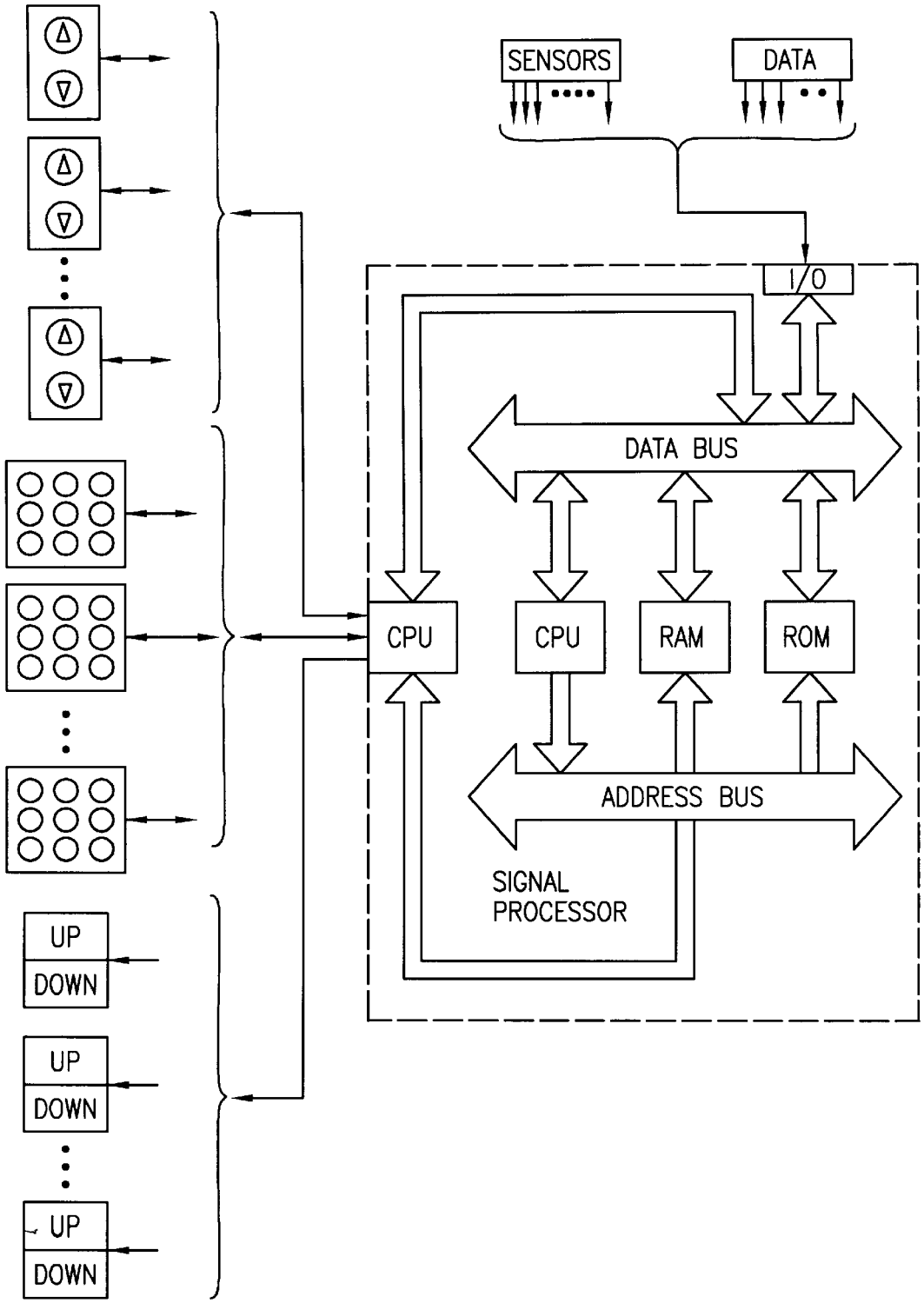
FIG. 8B shows an elevator dispatching and announcement system which includes a signal processor for carrying out the present invention.

FIG. 8A shows a dispatching algorithm which may utilize an RRT estimation technique, according to the present invention. In the first step, a down hall call is registered. Next, the RRT is calculated in the normal manner for each car, including those for which a horizon floor is nearby and in the direction travel. In those cases, however, RRT is adjusted by one of the methods shown above or similar as shown in FIG. 9 (discussed below). The best car then is selected and finally assigned to serve the registered down hall call. FIG. 8B shows an elevator car dispatching system which includes a signal processor for carrying out the algorithm of FIG. 8A as well as the standard RRT and adjustments thereto as disclosed herein. The signal processor is connected via various input/output (I/O) ports to various devices including hall call pushbuttons, car call pushbuttons, hall call lanterns, and various sensor and data signals.

In FIG. 9, after the RRT is calculated for a given car, a decision is made as to whether the particular car is appropriate for RRT adjustment. If so, a determination of the adjustment to be made is carried out by one of the methods shown above or similar. The resultant RRT is then provided. Of course, it should be realized that the decision as to whether a particular car is appropriate for RRT adjustment can be made at the outset and rather than calculating the RRT as usual and then making an adjustment, the RRT for that car can be treated differently from a regular RRT calculation from the outset.

Although illustrative embodiments of the present invention have been described in detail with reference to the accompanying drawings, it is to be understood that the invention is not limited to those precise embodiments since various changes or modifications may be effected therein by one skilled in the art without departing from the scope or spirit of the invention.

We claim:

1. Improved method for estimating remaining response time (RRT) for a candidate elevator car to serve a registered hall call, comprising the steps of:

determining a standard RRT based on the location of the candidate elevator car, direction of travel, distance of travel to the registered hall call, and number of stops for registered car calls before reaching the registered hall call; and determining if the candidate elevator car must stop at a floor with expected high traffic before reaching the registered hall call and if so, determining an adjustment to the standard RRT for providing an adjusted RRT and otherwise providing said standard RRT.

2. The method of claim 1, wherein said determining an adjustment to the standard RRT is made by adding a fixed RRT penalty thereto.

3. The method of claim 1, wherein said determining an adjustment to the standard RRT is made by adding time corresponding to an assumed car call stop at a selected floor.

4. The method of claim 1, wherein said determining an adjustment to the standard RRT is made by means of a neural network.

5. Improved apparatus for estimating remaining response time (RRT) for a candidate elevator car to serve a registered hall call, comprising:

means for determining a standard RRT based on the location of the candidate elevator car, direction of travel, distance of travel to the registered hall call, and numbers of stops for registered car calls before reaching the registered hall call; and means for determining if the candidate elevator car must stop at a floor with expected high traffic before reaching the registered hall call and means for determining an adjustment to the standard RRT for providing an adjusted RRT and otherwise providing said standard RRT.

6. The apparatus of claim 5, wherein said means for determining an adjustment to the standard RRT is made by means for adding a fixed RRT penalty thereto.

7. The apparatus of claim 5, wherein said means for determining an adjustment to the standard RRT is made by means for adding time corresponding to an assumed car call stop at a selected floor.

8. The apparatus of claim 5, wherein said means for determining an adjustment to the standard RRT is made by means of a neural network.

9. The method of claim 2, wherein said determining an adjustment to the standard RRT is made by means of neural network.

10. The method of claim 3, wherein said determining an adjustment to the standard RRT is made by means of neural network.

11. The apparatus of claim 6, wherein said means for determining an adjustment to the standard RRT is made by means of a neural network.

12. The apparatus of claim 7, wherein said means for determining an adjustment to the standard RRT is made by means of a neural network.

* * * * *